US009033415B2

(12) United States Patent
Hopke et al.

(10) Patent No.: US 9,033,415 B2
(45) Date of Patent: May 19, 2015

(54) DRIVEN INFANT SEAT

(71) Applicant: Thorley Industries LLC, Pittsburgh, PA (US)

(72) Inventors: Frederick Karl Hopke, Glenshaw, PA (US); Henry F. Thorne, West View, PA (US); Robert D. Daley, Pittsburgh, PA (US); John J. Walker, Pittsburgh, PA (US); Aaron S. Pavkov, Pittsburgh, PA (US); Suraj Joseph, Pittsburgh, PA (US)

(73) Assignee: Thorley Industries LLC, Pittsburgh, PA (US)

( * ) Notice: Subject to any disclaimer, the term of this patent is extended or adjusted under 35 U.S.C. 154(b) by 0 days.

(21) Appl. No.: 14/211,979

(22) Filed: Mar. 14, 2014

(65) Prior Publication Data

US 2014/0265490 A1 Sep. 18, 2014

Related U.S. Application Data

(60) Provisional application No. 61/878,256, filed on Sep. 16, 2013, provisional application No. 61/788,214, filed on Mar. 15, 2013.

(51) Int. Cl.
*A47D 13/10* (2006.01)
*A47D 9/02* (2006.01)

(52) U.S. Cl.
CPC . *A47D 13/10* (2013.01); *A47D 9/02* (2013.01)

(58) Field of Classification Search
CPC ..... A47D 13/10; A47D 9/02
USPC ..... 297/250.1, 258.1, 260.1, 260.2, 261.1, 297/261.2
See application file for complete search history.

(56) References Cited

U.S. PATENT DOCUMENTS

| | | | | |
|---|---|---|---|---|
| 184,305 | A | 11/1876 | Snyder | |
| 465,719 | A * | 12/1891 | Mitchell | 297/329 |
| 475,742 | A | 5/1892 | Palmer | |
| 1,032,614 | A | 7/1912 | Lamb | |
| 1,449,301 | A | 3/1923 | Shea | |
| 1,644,528 | A | 10/1927 | Huff | |
| 1,686,145 | A | 10/1928 | Cook | |
| 1,909,204 | A | 5/1933 | Marchese | |
| 2,070,468 | A | 2/1937 | Chapman | |
| 2,520,563 | A | 8/1950 | Preston | |
| 2,596,033 | A | 5/1952 | King | |
| 2,609,029 | A | 9/1952 | Haberstump | |
| 2,869,145 | A | 1/1959 | Gregory | |

(Continued)

FOREIGN PATENT DOCUMENTS

| | | | |
|---|---|---|---|
| DE | 4034561 | A1 | 5/1992 |
| DE | 202005017014 | U1 | 1/2006 |

(Continued)

*Primary Examiner* — Sarah B McPartlin
(74) *Attorney, Agent, or Firm* — The Webb Law Firm

(57) ABSTRACT

An infant rocking seat includes a base; a track provided on the base having a first arc-shaped portion and a second arc-shaped portion meeting at a crest; a carriage having a body portion, a first pair of wheels positioned at a first end of the body portion, and a second pair of wheels positioned at a second end of the body portion; and a drive mechanism configured to move the carriage along the track. The carriage is positioned within a central portion of the base and is configured to ride along the track. A distance between the first pair of wheels and the second pair of wheels is less than a distance between centers of curvature of the first arc-shaped portion and the second arc-shaped portion.

20 Claims, 12 Drawing Sheets

(56) References Cited

U.S. PATENT DOCUMENTS

| | | | | |
|---|---|---|---|---|
| 2,886,094 | A | 5/1959 | Pickles | |
| 3,078,479 | A | 2/1963 | Grosse et al. | |
| 3,259,355 | A | 7/1966 | Slouka | |
| 3,529,311 | A | 9/1970 | Crawford | |
| 3,608,855 | A | 9/1971 | Osenberg | |
| 3,653,080 | A | 4/1972 | Hafele | |
| 3,700,203 | A | 10/1972 | Adams | |
| 3,719,391 | A | 3/1973 | Neri | |
| 3,847,338 | A | 11/1974 | Adams | |
| 3,993,280 | A | 11/1976 | Surbaugh | |
| 3,999,539 | A | 12/1976 | Meador | |
| 3,999,799 | A | 12/1976 | Daswick | |
| 4,028,753 | A | 6/1977 | Rios | |
| 4,057,289 | A | 11/1977 | Jones | |
| 4,092,009 | A | 5/1978 | Koutsky | |
| 4,128,273 | A | 12/1978 | Jones | |
| 4,258,446 | A | 3/1981 | McAllister et al. | |
| 4,430,992 | A | 2/1984 | Christ | |
| 4,491,365 | A | 1/1985 | Murakami | |
| 4,531,459 | A | 7/1985 | Yamada | |
| 4,553,786 | A | 11/1985 | Lockett et al. | |
| 4,555,138 | A | 11/1985 | Hughes | |
| 4,620,334 | A | 11/1986 | Robinson | |
| 4,709,960 | A | 12/1987 | Launes | |
| 4,752,102 | A | 6/1988 | Rasmussen | |
| 4,752,980 | A | 6/1988 | Nafte | |
| 4,786,024 | A | 11/1988 | Goetz | |
| 4,899,631 | A | 2/1990 | Baker | |
| 4,911,499 | A | 3/1990 | Meeker | |
| 4,934,997 | A | 6/1990 | Skakas | |
| 4,941,709 | A | 7/1990 | Moller | |
| 4,970,740 | A | 11/1990 | Crawford | |
| 4,988,300 | A | 1/1991 | Yamaguchi et al. | |
| 5,014,960 | A | 5/1991 | Kimura | |
| 5,022,708 | A | 6/1991 | Nordella et al. | |
| 5,037,375 | A | 8/1991 | Gatts | |
| 5,107,555 | A | 4/1992 | Thrasher | |
| 5,112,018 | A | 5/1992 | Wahls | |
| 5,123,701 | A | 6/1992 | Bottamiller et al. | |
| 5,183,457 | A | 2/1993 | Gatts et al. | |
| 5,251,864 | A | 10/1993 | Itou | |
| 5,257,851 | A | 11/1993 | Kanaya | |
| 5,303,433 | A | 4/1994 | Jang | |
| 5,316,258 | A | 5/1994 | Gauger et al. | |
| 5,342,113 | A | 8/1994 | Wu | |
| 5,411,315 | A | 5/1995 | Greenwood | |
| 5,451,095 | A | 9/1995 | Riback | |
| 5,463,961 | A | 11/1995 | Graves | |
| 5,527,221 | A | 6/1996 | Brown et al. | |
| 5,574,339 | A | 11/1996 | Kattwinkel et al. | |
| 5,586,740 | A | 12/1996 | Borlinghaus et al. | |
| 5,615,428 | A | 4/1997 | Li | |
| 5,618,262 | A | 4/1997 | Rene | |
| 5,694,655 | A | 12/1997 | Shepler et al. | |
| 5,711,045 | A | 1/1998 | Caster et al. | |
| 5,765,916 | A | 6/1998 | Patel | |
| 5,823,847 | A | 10/1998 | Gellman | |
| 5,845,350 | A | 12/1998 | Beemiller et al. | |
| 5,887,945 | A | 3/1999 | Sedlack | |
| 5,935,012 | A | 8/1999 | Cohn et al. | |
| 6,000,757 | A | 12/1999 | Sovis | |
| 6,068,566 | A | 5/2000 | Kim | |
| 6,089,667 | A | 7/2000 | Hobbs | |
| 6,105,920 | A | 8/2000 | Gauger | |
| 6,264,158 | B1 | 7/2001 | Downey et al. | |
| 6,367,758 | B1 | 4/2002 | Garrido et al. | |
| 6,378,940 | B1 | 4/2002 | Longoria et al. | |
| 6,482,066 | B1 | 11/2002 | Kelly | |
| 6,488,640 | B2 | 12/2002 | Hood et al. | |
| 6,503,163 | B1 * | 1/2003 | Van Sant et al. | 474/101 |
| 6,519,792 | B2 | 2/2003 | Chen | |
| 6,574,806 | B1 | 6/2003 | Maher | |
| 6,677,720 | B2 | 1/2004 | Fraser | |
| 6,698,431 | B1 | 3/2004 | Harris | |
| 6,705,950 | B2 | 3/2004 | Wood et al. | |
| 6,739,659 | B2 | 5/2004 | Dukes | |
| 6,774,589 | B2 | 8/2004 | Sato et al. | |
| 6,808,458 | B1 | 10/2004 | Jung | |
| 6,811,217 | B2 | 11/2004 | Kane et al. | |
| 6,966,082 | B2 | 11/2005 | Bloemer et al. | |
| 6,971,127 | B2 | 12/2005 | Richards | |
| 7,062,146 | B2 | 6/2006 | Elias et al. | |
| 7,073,859 | B1 | 7/2006 | Wilson | |
| 7,281,284 | B2 | 10/2007 | Sims, Jr. | |
| 7,395,560 | B2 | 7/2008 | Bloemer et al. | |
| 7,478,446 | B2 | 1/2009 | Sims, Jr. | |
| 7,485,086 | B2 | 2/2009 | Dickie | |
| 7,506,922 | B2 * | 3/2009 | Schulte et al. | 297/131 |
| RE41,121 | E | 2/2010 | Asbach et al. | |
| D611,257 | S | 3/2010 | Jacobs et al. | |
| 7,669,927 | B1 * | 3/2010 | Zaid | 297/260.2 |
| 7,717,798 | B2 | 5/2010 | Bellows et al. | |
| 7,722,118 | B2 | 5/2010 | Bapst et al. | |
| 7,845,728 | B2 | 12/2010 | Chen et al. | |
| 7,874,617 | B2 | 1/2011 | Ogle | |
| 7,880,717 | B2 | 2/2011 | Berkley et al. | |
| 7,891,736 | B2 | 2/2011 | Sims, Jr. | |
| 7,958,579 | B2 | 6/2011 | Westerkamp et al. | |
| D645,264 | S | 9/2011 | Wiegmann et al. | |
| 8,047,609 | B2 | 11/2011 | Chen et al. | |
| 8,197,005 | B2 | 6/2012 | Hopke et al. | |
| 8,827,366 | B2 | 9/2014 | Hopke et al. | |
| 8,834,282 | B2 * | 9/2014 | Sclare et al. | 472/119 |
| 2002/0002741 | A1 | 1/2002 | Tomas et al. | |
| 2002/0113469 | A1 | 8/2002 | Stern et al. | |
| 2002/0140263 | A1 | 10/2002 | Sato et al. | |
| 2003/0067199 | A1 | 4/2003 | Asbach et al. | |
| 2003/0199328 | A1 | 10/2003 | Wood et al. | |
| 2004/0259648 | A1 | 12/2004 | Armbruster et al. | |
| 2005/0072451 | A1 | 4/2005 | Vivian et al. | |
| 2005/0091743 | A1 | 5/2005 | Bloemer et al. | |
| 2006/0012230 | A1 | 1/2006 | Kennedy et al. | |
| 2006/0025226 | A1 | 2/2006 | Nakano et al. | |
| 2006/0031985 | A1 | 2/2006 | Bloemer et al. | |
| 2006/0111194 | A1 | 5/2006 | Dillner et al. | |
| 2006/0199468 | A1 | 9/2006 | Mastrosimone-Gese | |
| 2006/0270480 | A1 | 11/2006 | Chen | |
| 2007/0205646 | A1 | 9/2007 | Bapst et al. | |
| 2007/0207870 | A1 | 9/2007 | Armbruster et al. | |
| 2007/0257534 | A1 | 11/2007 | Schulte et al. | |
| 2007/0275358 | A1 | 11/2007 | Nakanishi | |
| 2007/0293373 | A1 | 12/2007 | Nakanishi | |
| 2008/0136236 | A1 | 6/2008 | Kincaid et al. | |
| 2008/0179928 | A1 | 7/2008 | Chen et al. | |
| 2010/0013285 | A1 | 1/2010 | Stanz et al. | |
| 2010/0052376 | A1 | 3/2010 | Hopke et al. | |
| 2010/0052387 | A1 | 3/2010 | Hopke et al. | |
| 2010/0158199 | A1 | 6/2010 | Burton | |
| 2010/0164264 | A1 | 7/2010 | Zadai et al. | |
| 2010/0201171 | A1 | 8/2010 | Velderman et al. | |
| 2010/0218312 | A1 | 9/2010 | Quintas Mendes | |
| 2011/0074196 | A1 | 3/2011 | Chen et al. | |
| 2011/0084943 | A1 | 4/2011 | Berkley et al. | |
| 2011/0105237 | A1 | 5/2011 | Gillett et al. | |
| 2011/0230115 | A1 | 9/2011 | Wang et al. | |
| 2011/0230272 | A1 | 9/2011 | Pyrce et al. | |
| 2011/0275444 | A1 | 11/2011 | Tirelli | |
| 2011/0275445 | A1 | 11/2011 | Tuckey et al. | |
| 2012/0032879 | A1 | 2/2012 | Berkley et al. | |
| 2012/0073765 | A1 | 3/2012 | Hontz et al. | |
| 2012/0125543 | A1 | 5/2012 | Chambers et al. | |
| 2012/0261962 | A1 | 10/2012 | Huntsberger et al. | |
| 2012/0319968 | A1 | 12/2012 | Sakayori | |

FOREIGN PATENT DOCUMENTS

| | | | |
|---|---|---|---|
| JP | 10265140 | A | 10/1998 |
| WO | 2007093986 | A1 | 8/2007 |

* cited by examiner

DRIVEN INFANT SEAT

CROSS REFERENCE TO RELATED APPLICATIONS

This application is based on U.S. Provisional Patent Application Nos. 61/788,214, filed Mar. 15, 2013, and 61/878,256, filed Sep. 16, 2013, on which priority of this patent application is based and which are hereby incorporated by reference in their entirety.

BACKGROUND OF THE INVENTION

1. Field of the Invention

The present invention relates generally to a driven infant seat and, more particularly, to a seat for an infant or baby that can be moved by a drive mechanism.

2. Description of Related Art

Baby swings and bouncy seats have been used to hold, comfort, and entertain infants and babies for many years. Prior art bouncy seats are normally constructed with a wire frame that contains some resistance to deformation that is less than or equal to the weight of the child in the seat. Thus, when the child is placed in the seat, his or her weight causes a slight and temporary deformation in the wire structure that is then counteracted by the wire frame's resistance to deformation. The end result is that the child moves up and down slightly relative to the floor. This motion can be imparted to the seat by a caregiver for the purpose of entertaining or soothing the child.

Baby swings normally function in much the same way as swing sets for older children; however, the baby swing usually has an automated power-assist mechanism that gives the swing a "push" to continue the swinging motion in much the same way a parent will push an older child on a swing set to keep them swinging at a certain height from the ground.

There are some products that have recently entered the market that defy easy inclusion into either the bouncy or swing category. One such product includes a motorized motion that can move the infant laterally, but only has a single degree of motorized freedom and, is thus, limited in the motion profiles that can be generated. While the seat can be rotated so that the baby is moved back and forth in a different orientation, there remains only one possible motion profile.

For the above reasons and others, it is desirable to develop an improved rocking infant seat.

SUMMARY OF THE INVENTION

Accordingly, provided is a rocking infant seat that provides a unique motion. In accordance with one embodiment of the present invention, the infant rocking seat includes a base; a track provided on the base having a first arc-shaped portion and a second arc-shaped portion meeting at a crest; a carriage having a body portion, a first pair of wheels positioned at a first end of the body portion, and a second pair of wheels positioned at a second end of the body portion; and a drive mechanism configured to move the carriage along the track. The carriage is positioned within a central portion of the base and is configured to ride along the track. A distance between the first pair of wheels and the second pair of wheels is less than a distance between centers of curvature of the first arc-shaped portion and the second arc-shaped portion.

Alternatively to having the first arc-shaped portion and the second arc-shaped portion meet at a crest, a bumper or an end-of-travel stop may be positioned where the first arc-shaped portion and the second arc-shaped portion meet.

In addition, the distance between the centers of curvature of the first arc-shaped portion and the second arc-shaped portion may be less than a track diameter. The track diameter may be between about 16 inches and about 48 inches.

The carriage may be configured to support a seating portion. The seating portion may include a seat support tube coupled to the carriage, and a substantially elliptical seat coupled to a first end and a second end of the seat support tube. However, this is not to be construed as limiting the present invention as the seat of the seating portion may have any suitable shape. The seating portion may further include a toy bar having a first end coupled to the second end of the seat support tube and a second end extending over the seat.

A controller may be mounted within the base. The controller may include a user interface configured to receive input from the user for controlling the drive mechanism, as well as a device for communicating to the user information relating to the operating parameters of the infant seat. Such a device may be one or more LEDs, an LCD display, or any other suitable display. Alternatively, the user interface may be provided separate from the base and communicate with the controller wirelessly.

In accordance with another embodiment of the present invention, an infant seat includes: a base; a track positioned on a surface of the base; a carriage configured to move along the track; and a drive mechanism positioned on the surface of the base for driving the carriage to move along the track. The drive mechanism includes: a motor; a drive shaft driven by the motor; at least one spindle positioned to rotate on the drive shaft; and a string connected between the spindle and the carriage. Rotation of the drive shaft in a first direction pulls the carriage forward and rotation of the drive shaft in a second direction opposite to the first direction releases the carriage, thereby allowing the carriage to move in reverse without motor resistance. Alternatively, rotation of the drive shaft in a first direction pulls the carriage forward and the seat mass moving along the first arc-shaped portion and the second arc-shaped portion of the track pulls and "unwinds" the string from the spindle.

The drive system may further include a pulley connected to the motor and the drive shaft to rotate the drive shaft. The pulley may be centrally located along the length of the drive shaft. However, this is not to be construed as limiting the present invention as the pulley may be located at any suitable position along the length of the drive shaft. The drive system may also include a first spindle positioned at a first end of the drive shaft and a second spindle positioned at a second end of the drive shaft. The string may have a first end connected to the first spindle, a length that extends along a first side of the carriage, through a central portion of the carriage, and along a second side of the carriage, and a second end connected to the second spindle. Alternatively, the string may simply be anchored to each side of the carriage and not routed through the central portion thereof. The string may be manufactured from a high tensile strength ultra high molecular weight polyethylene. However, this is not to be construed as limiting the present invention as any material of suitable strength may be utilized in manufacturing the string.

The carriage may be configured to support a seating portion. The seating portion may include: a seat support tube coupled to the carriage; and a substantially elliptical seat coupled to a first end and a second end of the seat support tube. The seating portion may also include a toy bar having a first end coupled to the second end of the seat support tube and a second end extending over the seat.

The infant seat may further include a controller mounted within the base. The controller may include a user interface configured to receive input from the user for controlling the drive mechanism, as well as a device for communicating to the user information relating to the operating parameters of the infant seat. Such a device may be one or more LEDs, an LCD display, or any other suitable display. A plurality of sensors may provide feedback from the carriage and components of the drive system to the controller.

These and other features and characteristics of the device of the present disclosure, as well as the methods of operation and functions of the related elements of structures and the combination of parts and economies of manufacture, will become more apparent upon consideration of the following description and the appended claims with reference to the accompanying drawings, all of which form a part of this specification, wherein like reference numerals designate corresponding parts in the various figures. It is to be expressly understood, however, that the drawings are for the purpose of illustration and description only and are not intended as a definition of the limits of the device of the present disclosure. As used in the specification and the claims, the singular form of "a", "an", and "the" include plural referents unless the context clearly dictates otherwise.

DESCRIPTION OF THE INVENTION

Figure 1:
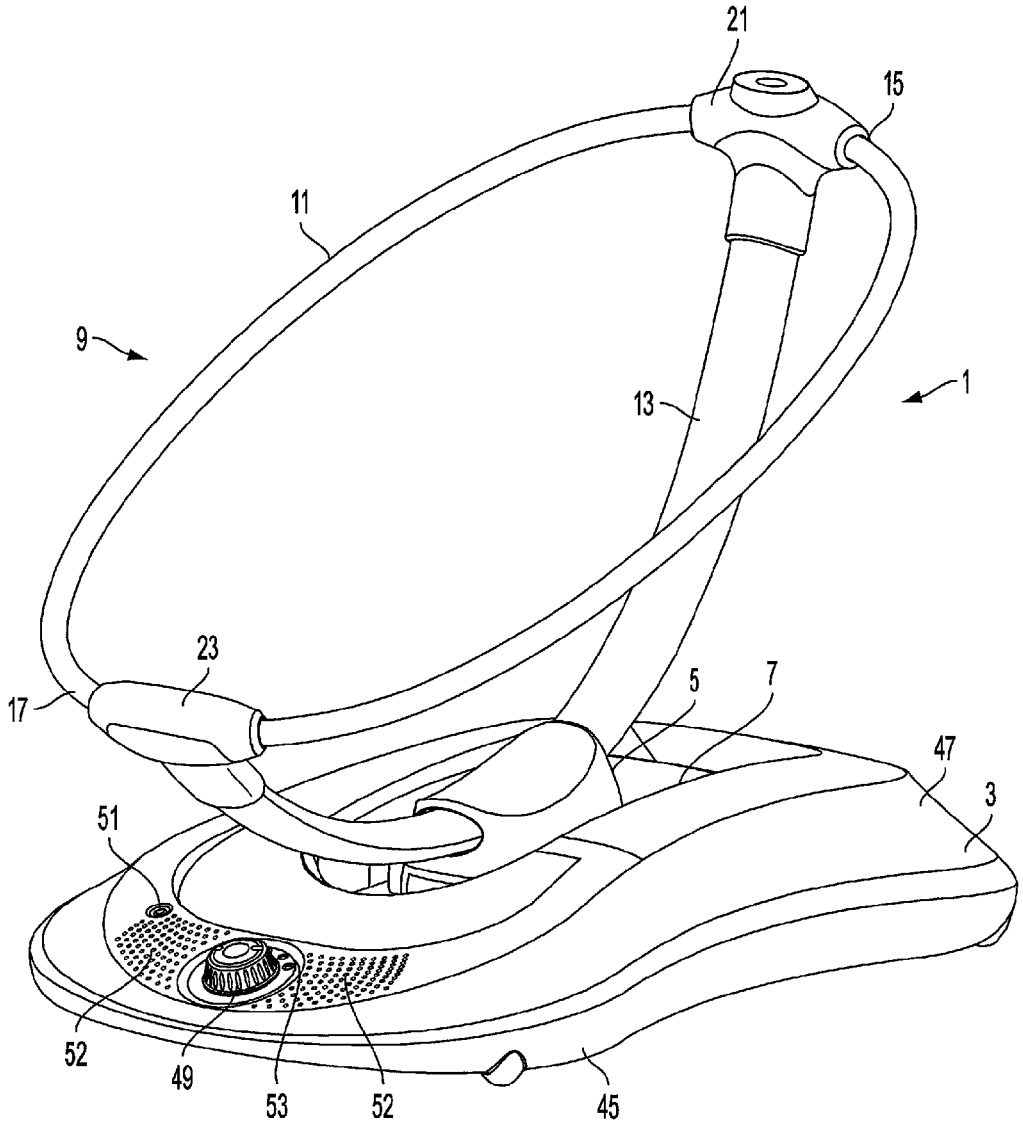
FIG. 1 is a front perspective view of a driven infant seat in accordance with one embodiment.

For purposes of the description hereinafter, the terms "upper", "lower", "right", "left", "vertical", "horizontal", "top", "bottom", "lateral", "longitudinal", and derivatives thereof, shall relate to the device of the present disclosure as it is oriented in the drawing figures. However, it is to be understood that the device of the present disclosure may assume various alternative variations, except where expressly specified to the contrary. It is also to be understood that the specific devices illustrated in the attached drawings, and described in the following specification, are simply exemplary embodiments of the device of the present disclosure. Hence, specific dimensions and other physical characteristics related to the embodiments disclosed herein are not to be considered as limiting.

A driven infant seat according to one embodiment is shown in FIGS. 1-16.

With reference to FIGS. 1-6, driven infant seat, denoted generally as reference numeral 1, includes a base 3, a carriage 5 configured to move within a central opening 7 formed within a central portion of the base 3, and a support device 9 coupled to the carriage 5. Support device 9 includes a seating portion 11 and an arcuate seat support tube 13. Seating portion 11 has a generally elliptical shape having an upper end 15 and a lower end 17 when viewed from above.

Figure 3:
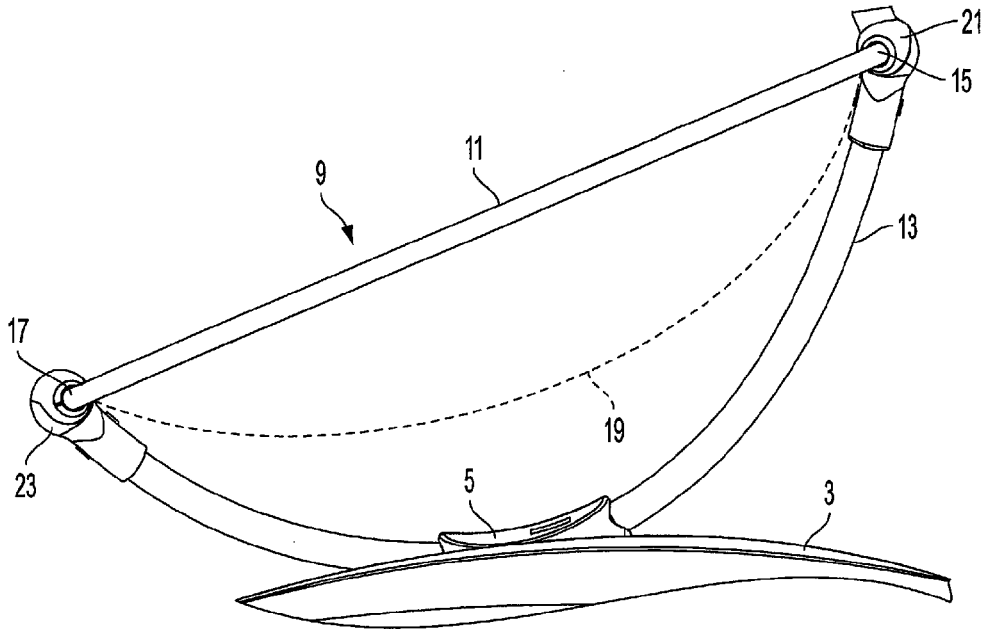
FIG. 3 is a side view of a seating portion of the driven infant seat of FIG. 1.

Seating portion 11 is designed to receive a fabric or other type of comfortable seat 19 for an infant as shown in phantom in FIG. 3. Seat 19 may be coupled to seating portion 11 using zippers, hook and loop fabric, buttons, snaps, or any other suitable fastening mechanism. In addition, seat 19 may further include a strap or other suitable restraint system (not shown) to secure a baby or infant to seat 19 as is well known in the art. Seat 19 is desirably manufactured in a variety of colors and patterns such that a parent or care provider can change the aesthetic look of driven infant seat 1 by interchanging seat 19 without replacing driven infant seat 1.

Seat support tube 13 is connected to upper end 15 of seating portion 11 via an upper connector 21 and curvedly extends away from the upper connector 21 toward lower end 17 of seating portion 11 where it is coupled to a lower connector 23. Seat support tube 13 is supported by, and rigidly engaged with, a curved passage 25 (see FIG. 5) in an upper portion of carriage 5 between upper connector 21 and lower connector 23. A locking mechanism operated by a cam mechanism 27 rigidly holds the support portion 9 to the carriage 5 when activated and allows support portion 9 to be removed from the carriage 5 when deactivated.

Figure 6:
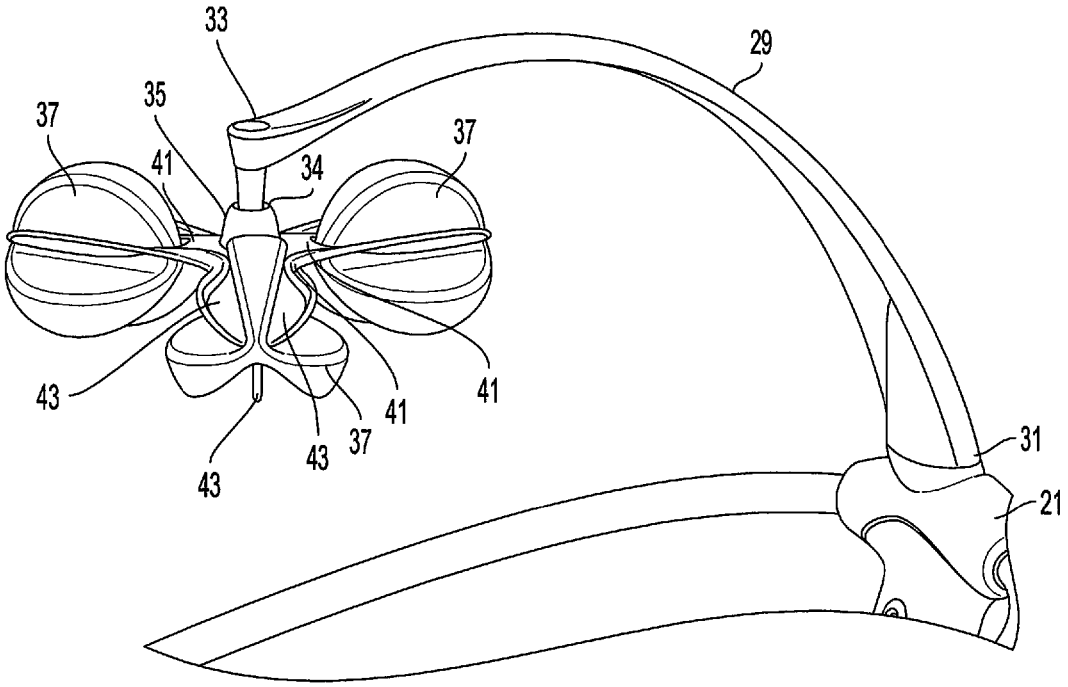
FIG. 6 is a perspective view of a toy bar assembly for use with the driven infant seat of FIG. 1.

In addition, a toy bar 29 is also provided as shown in FIG. 6. Toy bar 29 includes a first end 31 coupled to upper connector 21 and a second end 33 extending over seating portion 11. Second end 33 of toy bar 29 may include a toy hanger 35 disposed thereon for mounting one or a plurality of toys 37 to entertain the infant. The toy bar 29 is made from molded plastic and interfaces with toy hanger 35 using a ball-in-socket mechanism 39. There are three arms 41 extending from the center of the toy hanger 35 which each hold stuffed fabric toys 37. The arms 41 have three tines 43 that are designed to hold the toys 37 in place, and the toys 37 are sewn with a 3-web design. Each web slides between tines 43 to hold the toys 37 in place, but still allows for easy removal.

Base 3 includes a bottom support housing 45 with a top enclosure 47 positioned over and covering bottom support housing 45. A drive mechanism (see FIG. 9) is supported on bottom support housing 45. Base 3 houses control knob 49 coupled to a controller for viewing and controlling the speed of the drive mechanism as will be described in greater detail hereinafter. Base 3 may further include a portable music player input jack 51 for playing music or other pre-recorded soothing sounds through speakers 52. In addition, music and other pre-recorded sounds stored on a phone may also be played through speakers 52 by connecting the phone to the input jack 51. A display 53 that includes a plurality of LEDs to provide information to the user as the speed of the reciprocation motion may also be incorporated into base 3.

With reference to FIGS. 7-10, and with continuing reference to FIGS. 1-6, driven infant seat 1 further includes a motion mechanism, denoted generally as reference numeral 55, supported by bottom support housing 45 of base 3. The motion mechanism 55 when powered by a drive mechanism provides a rocking motion to the seating portion 11 of the driven infant seat 1. The motion mechanism 55 includes the carriage 5 and a track provided on the bottom support housing 45. The track includes a pair of parallel spaced track portions 57*a*, 57*b* each comprising a first arc-shaped portion 59 and a second arc-shaped portion 61 meeting at a crest 63. Carriage 5 includes a pair of extension arms 65 that extend into the base 3. Each of the extension arms 65 supports a pair of wheels 67*a*-67*d* such that a first set of wheels 67*a*, 67*b* are positioned at a front end of the carriage 5 and a second set of wheels 67*c*, 67*d* are positioned at a rear end of the carriage 5 (see FIG. 13). The wheels are arranged such that wheel 67*a* rides along first arc-shaped portion 59 of track portion 57*a*, wheel 67*b* rides along first arc-shaped portion 59 of track portion 57*b*, wheel 67*c* rides along second arc-shaped portion 61 of track portion 57*a*, and wheel 67*d* rides along second arc-shaped portion 61 of track portion 57*b*. In this manner, carriage 5 is positioned within central opening 7 of base 3 and is configured to ride along the track portions 57*a*, 57*b*.

The rocking motion provided to driven infant seat 1 is created by having carriage 5 rolling along track portions 57*a*, 57*b* that have a general geometry as described above and schematically shown in FIG. 8. Specific parameters which lead to the rocking motion include: (1) circular, elliptical, a clothoid curve having a linearly changing radius, or similarly rounded track geometry; (2) distance L between wheels 67*a*, 67*b* and 67*c*, 67*d* being less than the distance X between the centers of curvature of the first arc-shaped portion 59 and the second arc-shaped portion 61; (3) distance X between centers of curvature of the first arc-shaped portion 59 and the second arc-shaped portion 61 being less than the track diameter D; and (4) track diameter D being between 16 inches and 48 inches. Alternatively, with regard to item (3) above, the rocking motion of the driven infant seat 1 of the present invention could also be achieved with the distance X between centers of curvature of the first arc-shaped portion 59 and the second arc-shaped portion 61 being equal to or greater than the track diameter D by making the length of the carriage 5 very long.

Driven infant seat 1 has an inherent natural frequency at which it operates most efficiently. The control system, as discussed in greater detail hereinafter, is desirably tuned to move the driven infant seat 1 at the natural frequency to create a natural rocking motion and to minimize the amount of energy required to drive the driven infant seat 1. To this end, minimizing friction and rolling resistance in motion mechanism 55 is important. Conventional swings have few parts moving relative to one another and, thus, little friction. However, in the design of the driven infant seat 1 of the present invention, self-lubricating plastics and additional lubrication are used to reduce friction, rolling resistance is minimized by designing a rigid wheel and rolling surface, and wheels having a large wheel diameter reduce friction and minimize rolling noise.

Furthermore, a favorable motion for an infant seat exhibits a period between 1.5 and 3 seconds. Longer times result in a more gentle and desirable motion for the infant. In a swing, having a long period requires a very long swing arm which creates a larger overall size. However, for driven infant seat 1 disclosed herein, a small change to the track or wheel geometry can dramatically increase or decrease the period of the seat.

As opposed to a swing or most other infant seats, there are no linkages or mechanisms required next to or above the infant. This design allows for base 3 to be less than 6 inches in height, with only the support device 9 extending above this height. This also leads to a smaller overall footprint for the driven infant seat 1.

Figure 2:
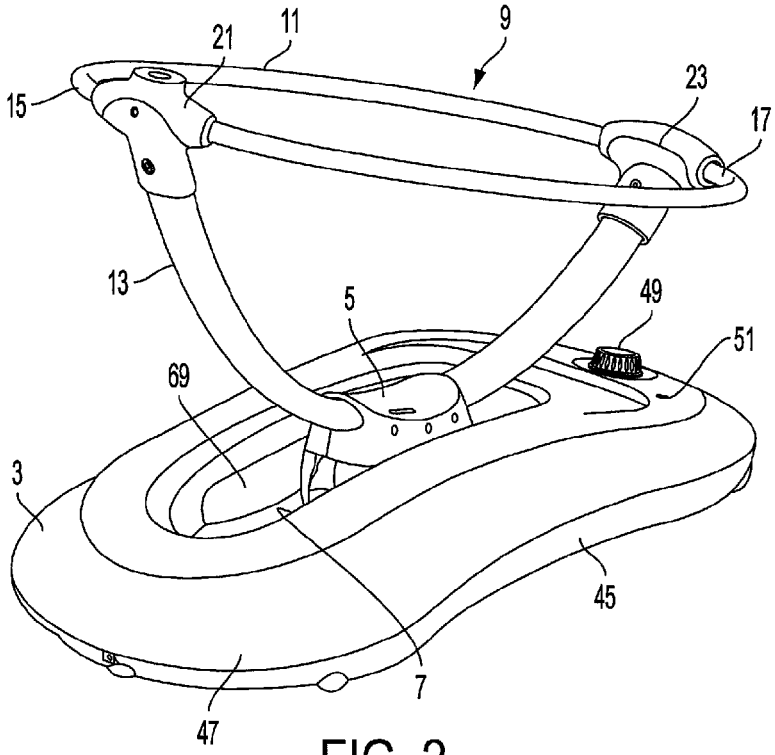
FIG. 2 is a rear perspective view of the driven infant seat of FIG. 1.
Figure 4:
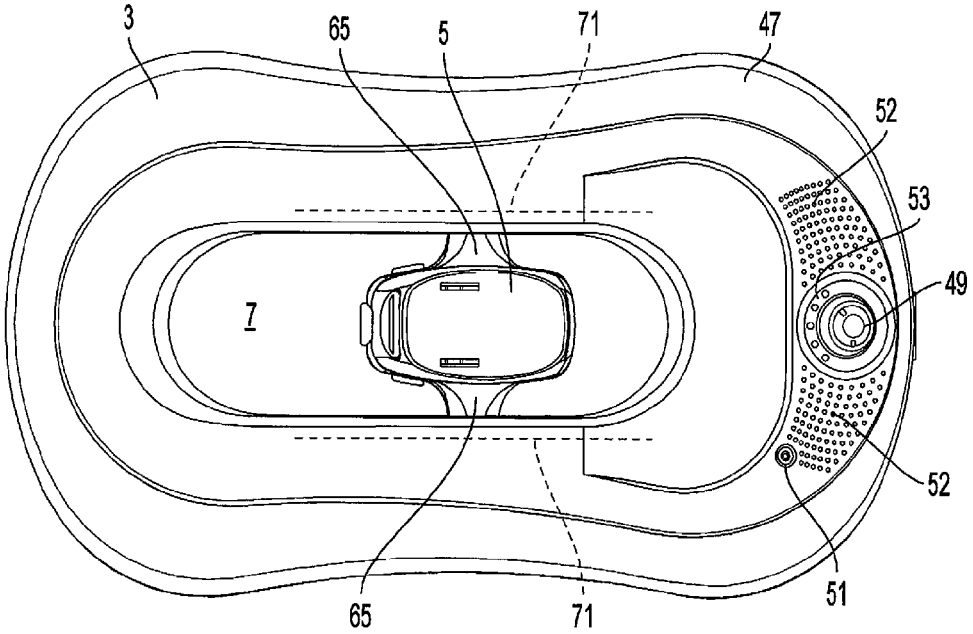
FIG. 4 is a top plan view of the driven infant seat of FIG. 1 with the seating portion removed.
Figure 5:
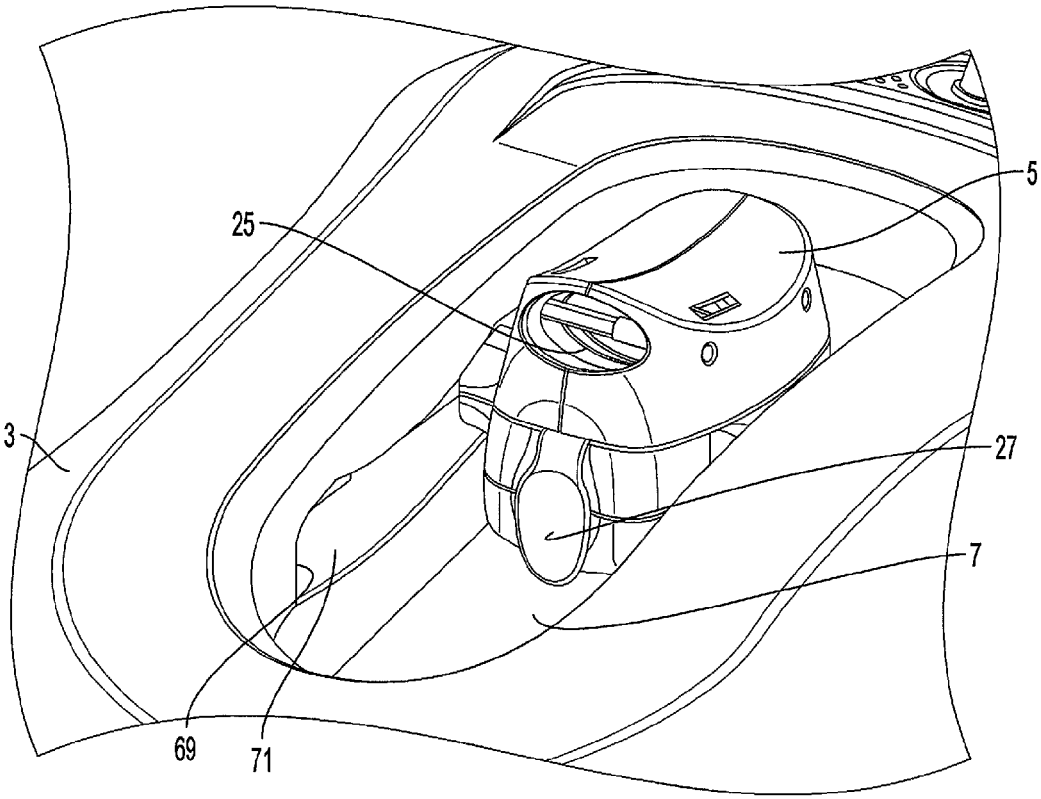
FIG. 5 is a rear perspective view of a portion of the driven infant seat of FIG. 1 with the seating portion removed.
Figure 7:
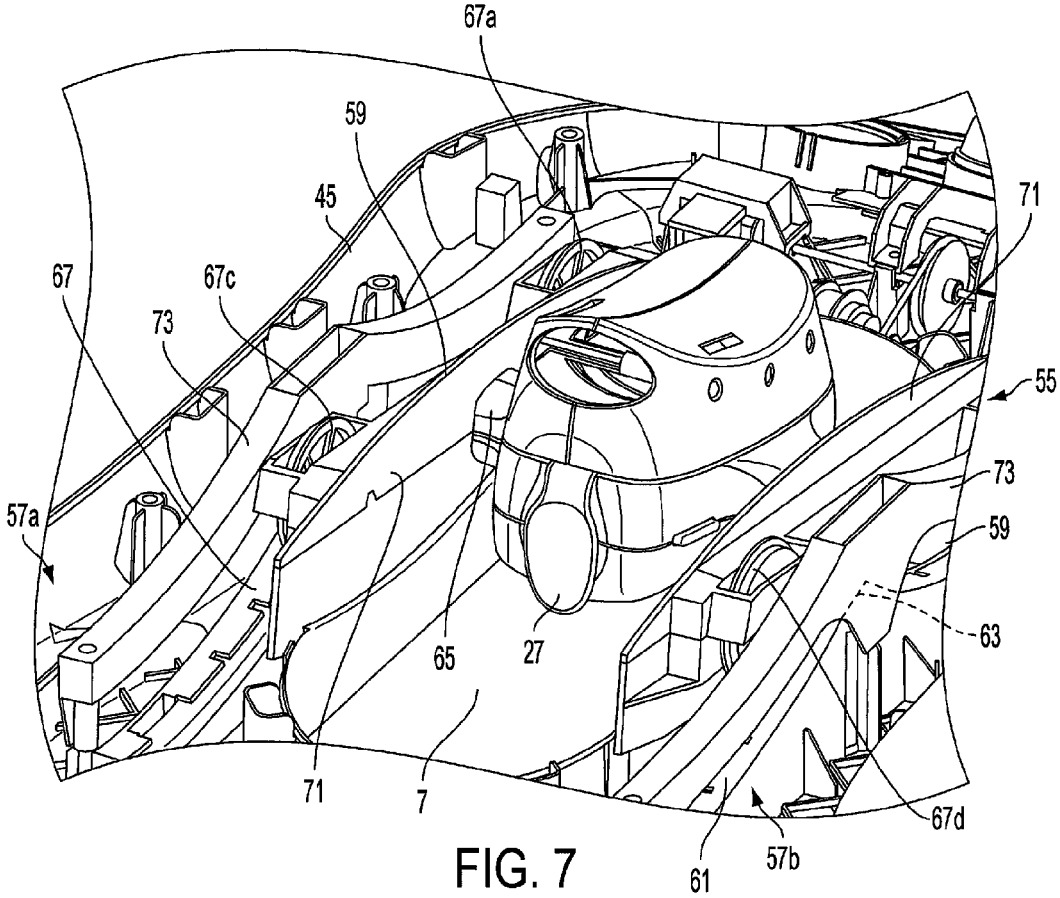
FIG. 7 is a rear perspective view of a portion of the driven infant seat of FIG. 1 with the seating portion and top base cover removed.
Figure 8:
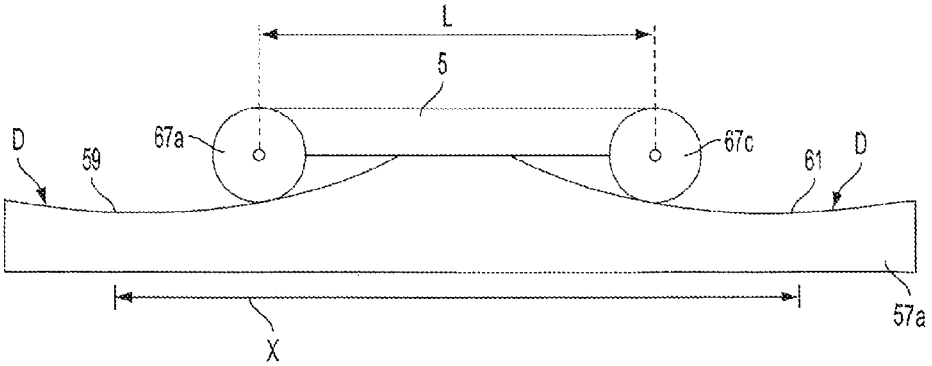
FIG. 8 is a schematic diagram of the carriage and track of the driven infant seat of FIG. 1.
Figure 13:
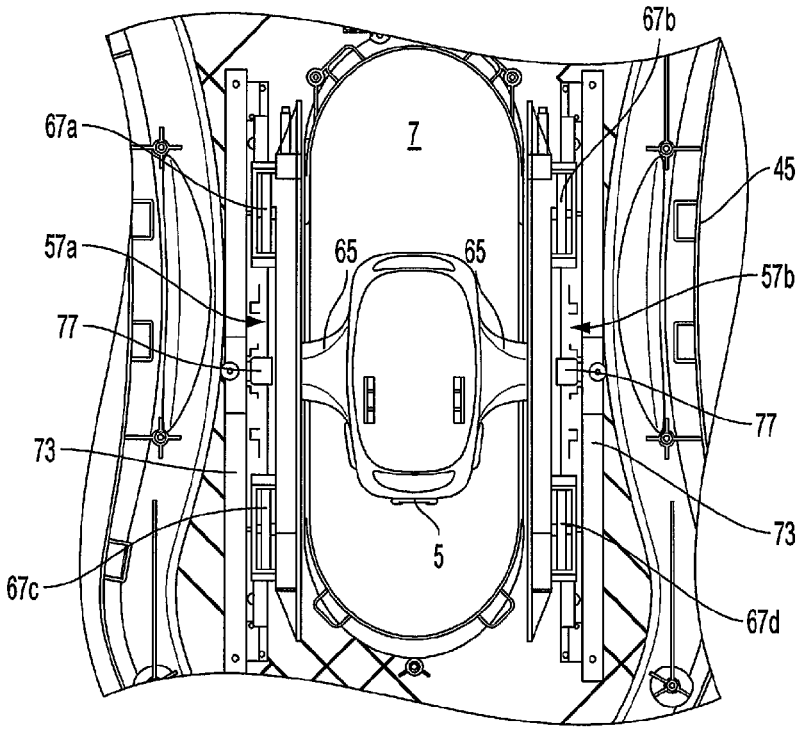
FIG. 13 is a top plan view of a portion of the driven infant seat of FIG. 1 with the top base cover and seating portion removed illustrating a device for limiting the movement of the carriage.
Figure 14:
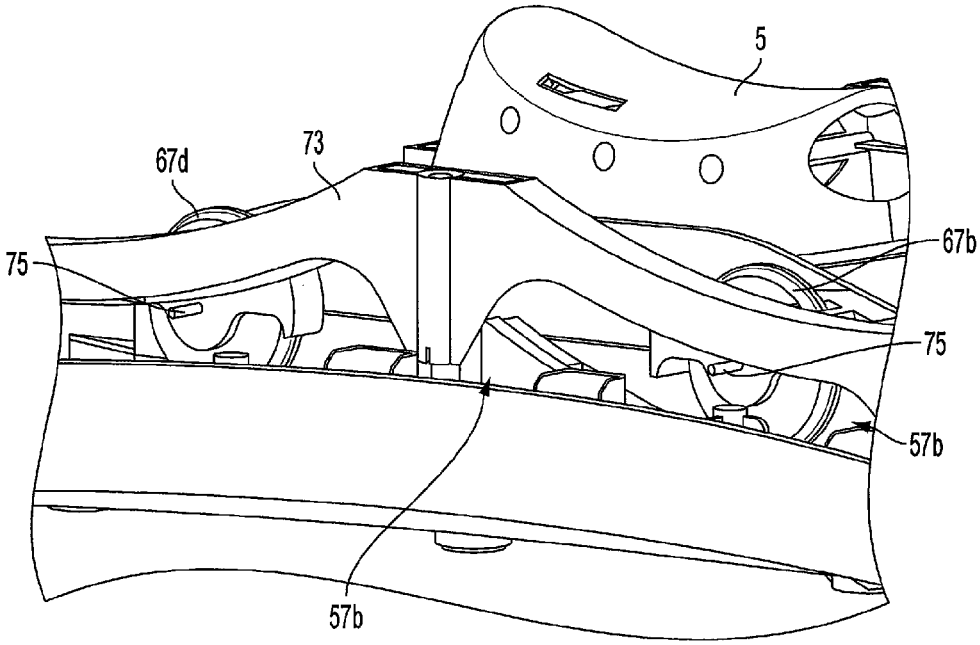
FIG. 14 is a perspective view of a portion of the driven infant seat of FIG. 1 with the seating portion and the top base cover removed.

Still further, driven infant seat 1 operates in a way that does not introduce pinch points or other unsafe conditions because carriage 5 includes a portion having a small cross-section (i.e., the extension arms 65) that extends through a slot 69 provided in the central opening 7 of the base 3 (see FIGS. 2, 4, and 5). Within the base 3, the carriage 5 then extends to the wheel locations as shown in FIGS. 7 and 13. This requires a rigid, strong material in the carriage 5 to prevent failure or sagging. With the aforementioned configuration, there would still be pinch points between the carriage 5 and the base 3 of the driven infant seat 1 within the slots 69. Accordingly, the carriage 5 includes large shields 71 that move within the base 3 in close proximity to the slot 69, but without making contact with the base 3. The shields 71 are shown in FIGS. 4, 5, and 7.

In order to prevent the carriage wheels 67*a*-67*d* from lifting off the track portions 57*a*, 57*b*, there is also a pair of shaft guide parts 73 inside the base 3 which guide the wheels 67*a*-67*d* along their motion but prevent them from lifting substantially when the driven infant seat 1 is lifted, the infant positioned within the driven infant seat 1 is off-centered, or the like. More specifically, and with reference to FIGS. 13 and 14, carriage 5 is free to move in an undesirable fashion if not properly constrained. For instance, if the driven infant seat 1 is loaded on the front edge of the seating portion 11, the rear wheels 67*c*, 67*d* will lift off the track portions 57*a*, 57*b*. In addition, if the driven infant seat 1 is picked up by the seating portion 11, the seating portion 11 will move relative to the base 3 in an undesirable manner.

To solve this problem, the two long shaft guide parts 73 are provided that are positioned just slightly above extended wheel axles 75 of the wheels 67*a*-67*d* of the carriage 5. If the carriage 5 is lifted off the track portions 57*a*, 57*b* for any reason, the shaft guide parts 73 limit the upward movement to a minimal distance. In effect, the carriage 5 and the support device 9 feel as though they are always riding along the track portions 57*a*, 57*b*.

Figure 15:
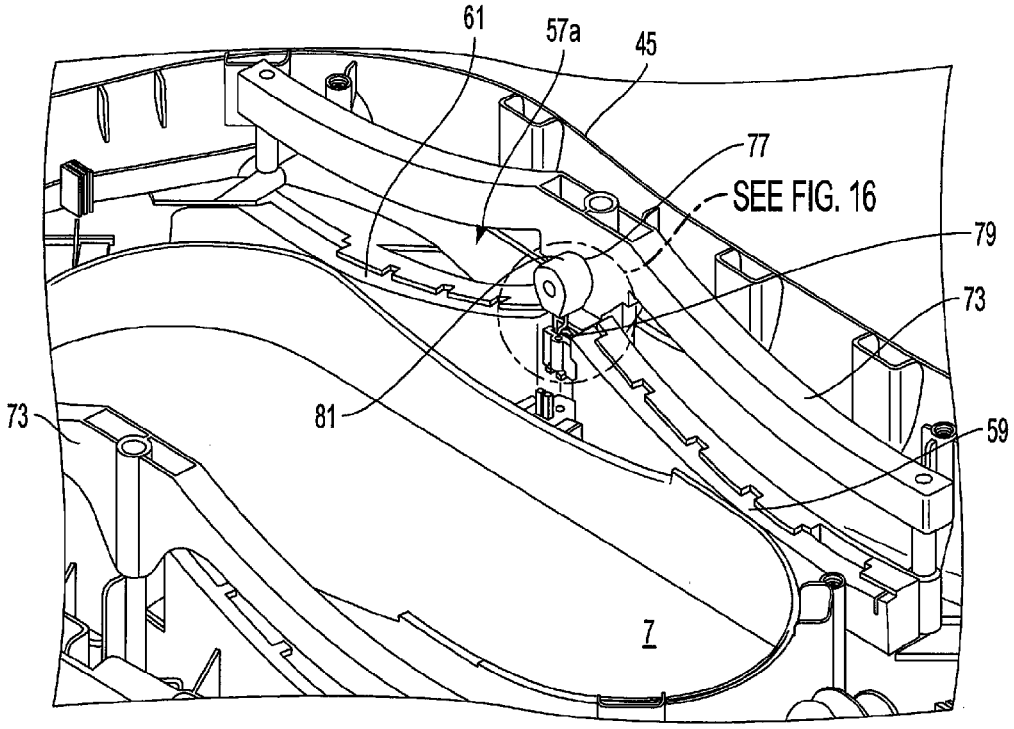
FIG. 15 is a perspective view of a portion of the driven infant seat of FIG. 1 with the seating portion and the top base cover removed.
Figure 16:
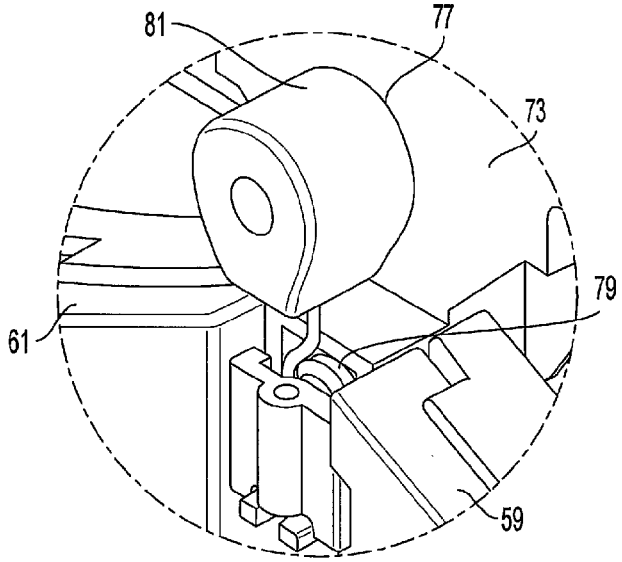
FIG. 16 is a perspective view of a portion of FIG. 15 enlarged for magnification purposes.

In a variety of other situations, the carriage 5 may arrive at its end of travel. When it does so, the carriage 5 hits a hard stop that is jarring to the touch and creates an undesirable noise. This also leads to a poor customer experience. Accordingly, a bumper assembly 77 is provided at the crest 63 of each of the track portions 57*a*, 57*b* as shown in FIGS. 13, 15, and 16. These bumper assemblies 77 are designed to come into contact with the carriage 5 before the carriage 5 reaches its end of travel. Each bumper assembly 77 absorbs impact energy at the end of travel and helps to return the carriage 5 to its "normal" range of travel. It does so by utilizing a torsion spring 79 secured to a portion of the bottom support housing 45 of the base 3 of the driven infant seat 1. In addition, the bumper assemblies 77 each have an elastomer part 81 mounted to the top of the torsion spring 79 that contacts a portion of the carriage 5 directly that makes the contact virtually silent.

Figure 9:
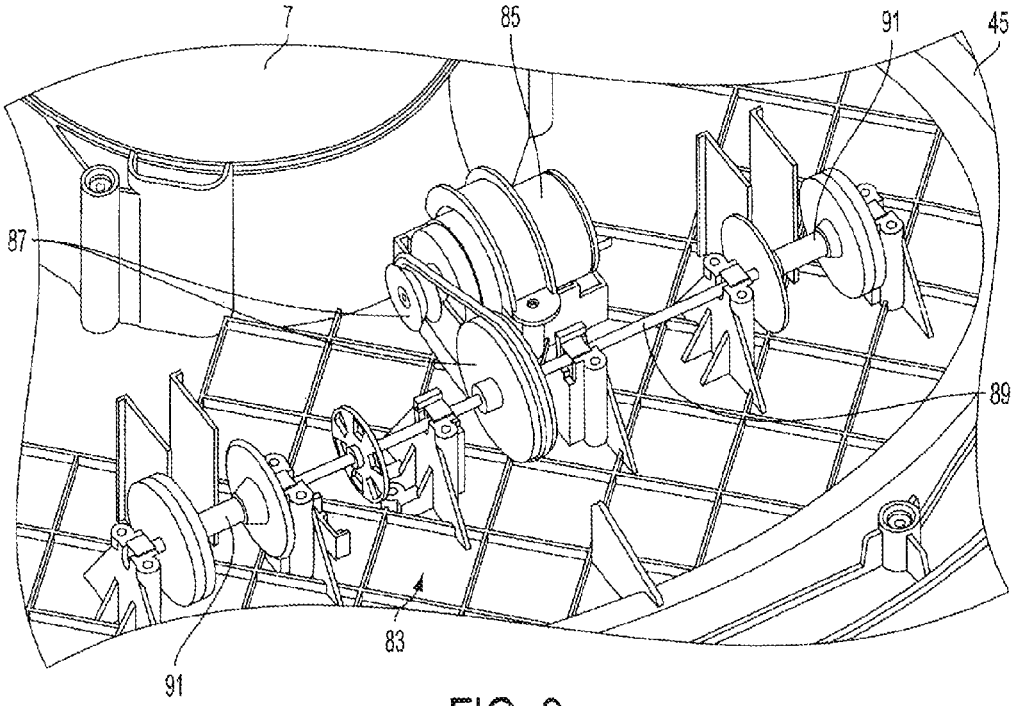
FIG. 9 is a perspective view of the drive mechanism of the driven infant seat of FIG. 1.
Figure 10:
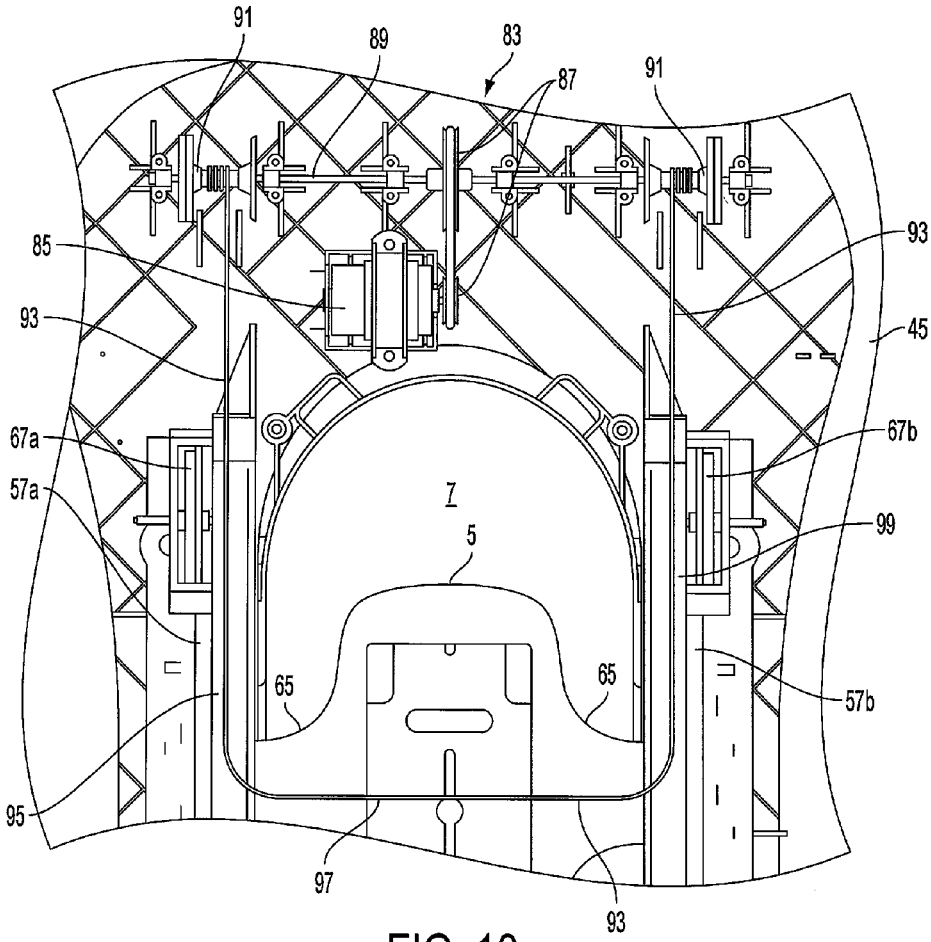
FIG. 10 is a top plan view of a portion of FIG. 4 with the top base cover removed.

With specific reference to FIGS. 9 and 10, a string drive mechanism 83 is mounted on the bottom support housing 45 for driving the motion mechanism 55 to move back and forth. The drive mechanism 83 includes a motor 85 turning a pulley 87 which turns a drive shaft 89. Spindles 91 are provided on each end of the drive shaft 89 which wind a high tensile strength UHMWPE (ultra-high molecular weight polyethylene) string 93 that is attached to the carriage 5. This winding pulls the carriage 5 forward toward the front of the driven infant seat 1. The motor 85 turns in reverse each cycle to release the string 93. The weight of the carriage 5 and the baby positioned within the seating portion 11 can also turn the motor 85 in reverse, but this takes energy away from the seat motion.

The attachment method of the string 93 to the carriage 5 is as follows. If the string 93 were to only pull on one side of the carriage 5, there would be some racking motion and energy loss. By having a spindle 91 and a string 93 on each side of the carriage 5, the racking is reduced, but difficult to eliminate. Accordingly, the carriage 5 is provided with a U-shaped tube that includes a first low-friction tube portion 95, a central passage portion 97, and a second low-friction tube portion 99. The string 93 is routed through the first low-friction tube portion 95 provided on a first side of the carriage 5 through the central passage portion 97 and back out the second low-friction tube portion 99 provided on the opposite side of the carriage 5. This arrangement allows the string 93 to freely slide and automatically adjust length, thereby providing equal string tension on each side of the carriage 5 (see FIG. 10).

Figure 11:
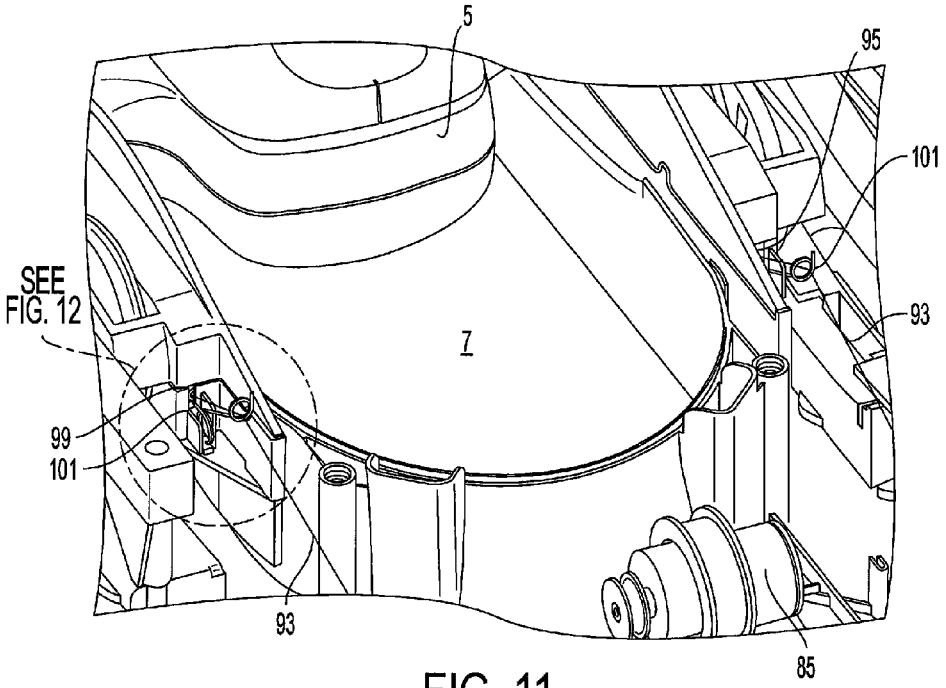
FIG. 11 is a front perspective view of a portion of the driven infant seat of FIG. 1 with the seating portion and top base cover removed.
Figure 12:
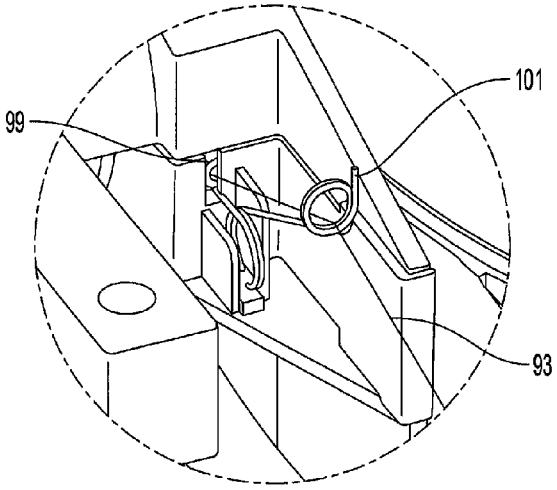
FIG. 12 is a perspective view of a portion of FIG. 11 enlarged for magnification purposes.

With reference to FIGS. 11 and 12, an important aspect of this disclosure is the manner in which the string 93 of the string drive mechanism 83 is managed to allow for consistent performance of the driven infant seat 1. The string drive mechanism 83 described hereinabove creates slack in the string 93 that needs to be reduced to prevent tangling during motion. To help reduce such slack, two torsion springs 101 are mounted to the front of the carriage 5 in front of each of the low-friction tubes 95, 99. These light-duty springs 101 are deflected as tension is placed on the string 93, and after tension is released, return to their original positions, thereby reducing string slack. A secondary purpose of the torsion springs 101 is to prevent string vibration. When there is significant weight placed in the seating portion 11, a sudden pull on the string 93 can cause it to vibrate and create a "plucking" noise. With the torsion spring 101 applying a small load on the string 93, this vibration is dampened and the noise is silenced.

Figure 17:
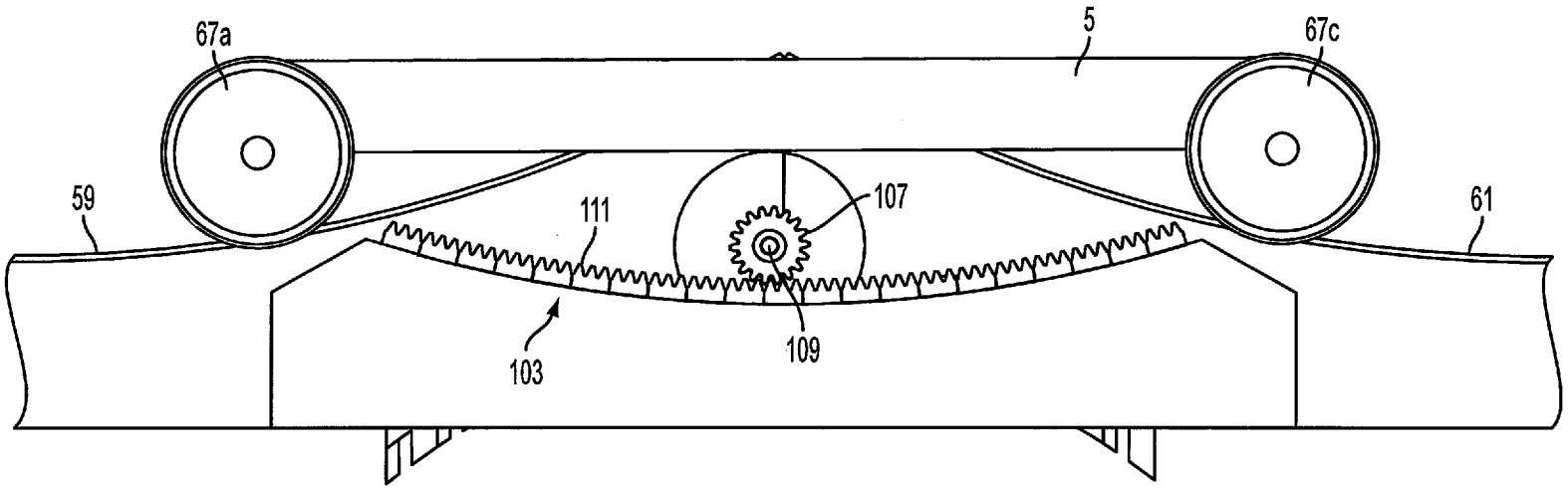
FIG. 17 is a schematic diagram of the carriage and track of the driven infant seat having an alternative drive mechanism.
Figure 18:
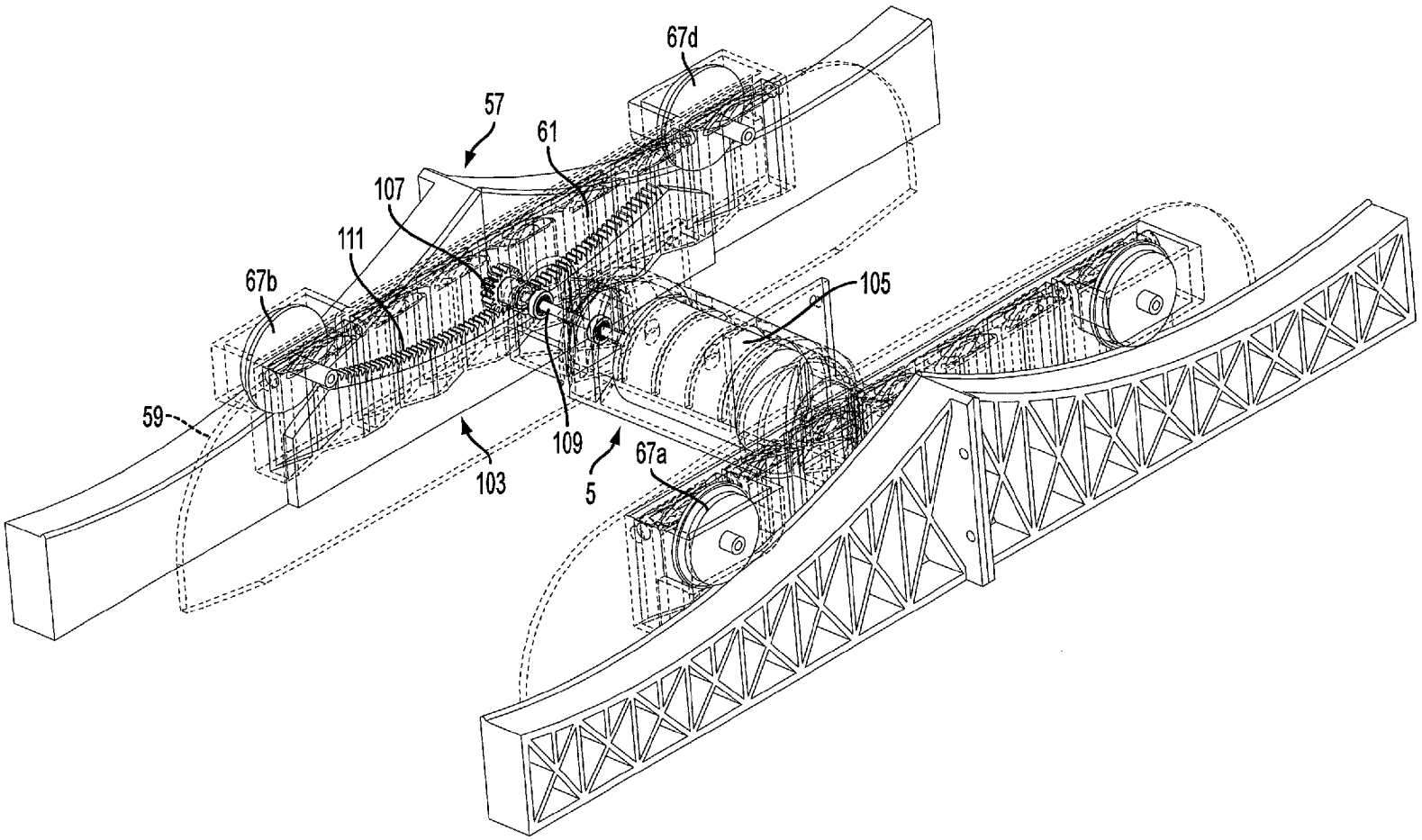
FIG. 18 is a perspective view of the driven infant seat incorporating the drive mechanism of FIG. 17.

An alternative drive mechanism 103 that may be utilized is illustrated in FIGS. 17 and 18. Drive mechanism 103 is based on a rack and pinion approach and includes a motor 105 contained within or attached to the carriage 5, a gear 107 at the end of an extended motor drive shaft 109, and a curved rack section 111 that is positioned adjacent to the track 57 and includes a plurality of teeth. Drive mechanism 103 operates by powering the motor 105, which rotates the gear 107, which in turn moves the gear 107 along the rack section 111 and the wheels 67*a*-67*d* of the carriage 5 along the track 57. In order for such a drive mechanism 103 to function properly, the geometry of the rack section 111 must be configured such that a gear pitch circle is always tangent to a rack pitch arc. In addition, the carriage 5 must be geometrically constrained to the rack section 111 and track 57 to ensure the teeth of the gear 107 do not disengage from the rack section 111 or slip.

The use of such a drive mechanism 103 is advantageous in that the motor 105 has the ability to control the motion of the carriage 5 at all times during operation. The motor 105 may operate only in one direction, and unpowered in the opposite direction. However, the motor 105 may also operate and control motion in both directions.

As another alternative, the drive mechanism may include a friction wheel rather than gear 107 and a curved section for receiving the friction wheel rather than curved rack section 111 having teeth and function similarly to drive mechanism 103 described hereinabove.

Returning to FIGS. 1-16, the control system, desirably configured as a microprocessor, of the driven infant seat 1 is responsible for producing a smooth, controlled seat motion and works for weights ranging from 0-25 lbs. The driven infant seat 1 has to be moved forward and then allowed to move backward periodically, in a rocking-horse type of motion. The amplitude of the motion, i.e., the distance from the center of the track portions 57*a*, 57*b* to which the seating portion 11 is pulled forward, is determined by the speed settings available to the user.

The motion of the driven infant seat 1 can be divided into the forward cycle and the reverse cycle. In the forward cycle, the carriage 5 and the support device 9 are pulled forward from rest until it comes to a stop, and in the reverse cycle, the carriage 5 and the support device 9 are released and fall back under the force of gravity to return to their original position using the physics of a pendulum.

In the forward cycle, potential energy is added to the system by pulling on the carriage 5 for a small period of time. This is accomplished by using a string 93 connected between the carriage 5 and the drive shaft 89 of the drive mechanism 83. When the carriage 5 needs to be pulled forward, the motor 85 is energized by the control system and starts rotating. This rotation winds up the string 93 around the spindles 91 of the drive shaft 89. As a result, the string 93 starts moving forward and this, in turn, pulls the carriage 5 in the same direction.

If the control system detects an overshoot, i.e., the carriage 5 moves beyond the desired amplitude, the control system causes the motor to pull the string 93 and thereby the carriage 5 with less force in the subsequent forward cycle. Similarly, if the system detects an undershoot, i.e., the carriage 5 is unable to reach the desired amplitude, the control system causes the motor to pull the string 93 and thereby the carriage 5 with more force in the subsequent forward cycle. Hence, the control system continuously monitors the actual motion of the carriage 5 and adjusts the speed of the motor 85 at the beginning of every forward cycle. When the carriage 5 reaches the desired amplitude in its forward motion, the forward cycle comes to an end and the reverse cycle begins.

In the reverse cycle, the carriage 5 has enough potential energy to return back on its own. However, this is only possible if there is enough string slack in the system. In other words, the string 93 wrapped around the spindles 91 of the drive shaft 89 has to be unwound quickly as the carriage 5 is falling backwards; otherwise it will impede the backward motion of the carriage 5. The control system accomplishes this by first predicting the distance the carriage 5 will travel backward, and then releasing the corresponding amount of string 93. When the carriage 5 reaches the most negative amplitude in its reverse motion, the forward cycle begins again and so on.

The control system uses a plurality of infrared (IR) sensors (not shown) to create a position measurement system for the seat, as well as provide a manner in which to monitor the amount of string 93 wrapped around the spindles 91.

While specific embodiments of the device of the present disclosure have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the device of the present disclosure which is to be given the full breadth of the claims appended and any and all equivalents thereof.

The invention claimed is:

1. An infant seat comprising:

a base;

a track provided on the base having a first arc-shaped portion and a second arc-shaped portion meeting at a crest;

a carriage comprising a body portion, a first pair of wheels positioned at a first end of the body portion, and a second pair of wheels positioned at a second end of the body portion, the carriage positioned within a central portion of the base and configured to ride along the track; and a drive mechanism configured to move the carriage along the track, wherein a distance between the first pair of wheels and the second pair of wheels is less than a distance between centers of curvature of the first arc-shaped portion and the second arc-shaped portion.

2. The infant seat of claim 1, wherein the carriage supports a seating portion.

3. The infant seat of claim 2, wherein the seating portion comprises: a seat support tube coupled to the carriage; and a substantially elliptical seat coupled to a first end and a second end of the seat support tube.

4. The infant seat of claim 2, wherein the seating portion further comprises a toy bar.

5. The infant seat of claim 1, further comprising a controller mounted within the base.

6. The infant seat of claim 5, wherein the controller includes a user interface configured to receive input from a user for controlling the drive mechanism and a device for communicating to the user information relating to operating parameters of the infant seat.

7. The infant seat of claim 1, wherein the distance between the centers of curvature of the first arc-shaped portion and the second arc-shaped portion is less than a track diameter.

8. The infant seat of claim 1, wherein a diameter of the track is between about 16 inches and about 48 inches.

9. An infant seat comprising:

a base;

a track positioned on a surface of the base;

a carriage configured to move along the track; and a drive mechanism positioned on the surface of the base for driving the carriage to move along the track, the drive mechanism comprising:

a motor;

a drive shaft driven by the motor;

at least one spindle positioned to rotate on the drive shaft; and a string connected between the spindle and the carriage, wherein rotation of the drive shaft in a first direction pulls the carriage forward and rotation of the drive shaft in a second direction opposite to the first direction releases the carriage.

10. The infant seat of claim 9, wherein the drive system further comprises a pulley connected to the motor wherein the motor turns the pulley causing rotation of the drive shaft.

11. The infant seat of claim 10, wherein the pulley is centrally located along the length of the drive shaft.

12. The infant seat of claim 11, wherein the drive system comprises a first spindle positioned at a first end of the drive shaft and a second spindle positioned at a second end of the drive shaft.

13. The infant seat of claim 12, wherein the string has a first end connected to the first spindle, a length that extends along a first side of the carriage, through a central portion of the carriage, and along a second side of the carriage, and a second end connected to the second spindle.

14. The infant seat of claim 9, wherein the string is a high tensile strength ultra high molecular weight polyethylene.

15. The infant seat of claim 9, wherein the carriage supports a seating portion.

16. The infant seat of claim 15, wherein the seating portion comprises: a seat support tube coupled to the carriage; and a substantially elliptical seat coupled to a first end and a second end of the seat support tube.

17. The infant seat of claim 15, wherein the seating portion further comprises a toy bar.

18. The infant seat of claim 9, further comprising a controller mounted within the base.

19. The infant seat of claim 18, wherein the controller includes a user interface configured to receive input from the user for controlling the drive mechanism and a device for communicating to the user information relating to operating parameters of the infant seat.

20. The infant seat of claim 18, further comprising a plurality of sensors to provide feedback from the carriage and components of the drive system to the controller.

* * * * *

UNITED STATES PATENT AND TRADEMARK OFFICE

CERTIFICATE OF CORRECTION

PATENT NO. : 9,033,415 B2
APPLICATION NO. : 14/211979
DATED : May 19, 2015
INVENTOR(S) : Frederick Karl Hopke et al.

It is certified that error appears in the above-identified patent and that said Letters Patent is hereby corrected as shown below:

In the claims,
Column 10, Line 16, Claim 10, delete "motor" and insert -- motor, --

Signed and Sealed this
Twenty-ninth Day of March, 2016

Michelle K. Lee

Michelle K. Lee
*Director of the United States Patent and Trademark Office*